US010779641B2

(12) United States Patent
Beere

(10) Patent No.: US 10,779,641 B2
(45) Date of Patent: Sep. 22, 2020

(54) FOLDAWAY SHELVING WITH MOVABLE END CAPS

(71) Applicant: Ranger Design, Montreal (CA)

(72) Inventor: Gary Wayne Beere, Pointe-Claire (CA)

(73) Assignee: RANGER DESIGN, Montreal (CA)

( * ) Notice: Subject to any disclaimer, the term of this patent is extended or adjusted under 35 U.S.C. 154(b) by 27 days.

(21) Appl. No.: 16/282,196

(22) Filed: Feb. 21, 2019

(65) Prior Publication Data

US 2019/0254422 A1 Aug. 22, 2019

Related U.S. Application Data

(60) Provisional application No. 62/633,462, filed on Feb. 21, 2018.

(51) Int. Cl.

| | |
|---|---|
| ***A47B 43/00*** | (2006.01) |
| ***A47B 96/06*** | (2006.01) |
| ***A47B 96/07*** | (2006.01) |
| ***A47B 96/02*** | (2006.01) |
| ***A47B 96/14*** | (2006.01) |

(52) U.S. Cl.

CPC ..... *A47B 43/00* (2013.01); *A47B 96/027* (2013.01); *A47B 96/061* (2013.01); *A47B 96/07* (2013.01); *A47B 96/14* (2013.01); *A47B 96/1425* (2013.01)

(58) Field of Classification Search

CPC ..... A47B 43/00; A47B 96/027; A47B 96/061; A47B 96/07; A47B 96/14; A47B 96/1425; A47B 57/045; A47B 57/04; A47F 5/103; A47F 5/12

USPC ..... 108/59–110, 162–193

See application file for complete search history.

(56) References Cited

U.S. PATENT DOCUMENTS

| | | | | | |
|---|---|---|---|---|---|
| 2,199,981 | A * | 5/1940 | Bell | A47B 5/04 | 108/38 |
| 2,231,261 | A * | 2/1941 | Eustis | A47F 5/103 | 108/185 |
| 2,788,902 | A * | 4/1957 | Nowicki | A47B 96/028 | 108/157.13 |
| 2,919,034 | A * | 12/1959 | Levy | A47B 57/045 | 108/1 |
| 3,120,199 | A * | 2/1964 | Kolster | A47B 57/04 | 108/6 |
| 3,130,693 | A * | 4/1964 | Shell | A47B 57/425 | 108/108 |
| 3,151,576 | A * | 10/1964 | Patterson | A47F 5/0087 | 108/2 |

(Continued)

*Primary Examiner* — Patrick D Hawn

(74) *Attorney, Agent, or Firm* — William H. Honaker; Dickinson Wright PLLC

(57) ABSTRACT

The foldaway shelving unit has movable end caps and at least a first shelf and a second shelf mounted for pivotal movement with respect to the shelf support. A first movable end cap is mounted adjacent the first end of the first shelf and a second movable end cap is mounted adjacent the second end of said second shelf. The shelves can be independently pivoted between a lowered position and a raised position. When the shelves are in the lowered position, the first and second movable end caps form a bridge between the shelves. When one of the shelves is in the raised position, and the other shelf is in the lowered position, the pivot bracket raises one of the movable end caps with respect to the lowered shelf and at least a portion of the vertical wall of the second movable end cap is above the support surface of the lowered shelf.

24 Claims, 9 Drawing Sheets

(56) References Cited

U.S. PATENT DOCUMENTS 3,167,037 A * 1/1965 Mapson ..... A47B 57/045 108/6
3,830,375 A * 8/1974 Larson ..... A47F 5/0018 211/59.1
5,117,986 A * 6/1992 Lin ..... A47B 57/20 108/2
5,236,104 A * 8/1993 Stingel, Jr. ..... G07F 11/34 193/27
5,655,459 A * 8/1997 O'Connor ..... A47B 5/06 108/134
D383,336 S * 9/1997 Van Der Merwe ..... D34/21
5,779,094 A * 7/1998 Stingel, Jr. ..... B65G 1/08 221/2
6,302,282 B1 * 10/2001 Gay ..... A47B 57/045 108/152
6,571,969 B2 * 6/2003 Larbaletier ..... A47F 5/12 108/106
7,757,615 B2 * 7/2010 McDonald, II ..... A47B 57/20 108/108
8,234,983 B2 * 8/2012 Randolph ..... A47B 47/022 108/108
8,286,779 B2 * 10/2012 Stingel, III ..... B65G 1/026 198/347.1
9,878,649 B2 * 1/2018 Beere ..... B60N 3/001
10,555,604 B2 * 2/2020 Robinson ..... A47B 57/487
2002/0023889 A1 * 2/2002 Larbaletier ..... A47F 5/12 211/150
2003/0034356 A1 * 2/2003 Freudelsperger .... B65G 1/1376 221/289
2003/0127482 A1 * 7/2003 Gort ..... B60P 3/14 224/549
2005/0211140 A1 * 9/2005 McDonald, II ..... A47B 46/005 108/108
2009/0173705 A1 * 7/2009 Stingel, III ..... B65G 1/026 211/150
2017/0095076 A1 * 4/2017 O'Keefe ..... A47B 57/04

* cited by examiner

FOLDAWAY SHELVING WITH MOVABLE END CAPS

CROSS-REFERENCE TO RELATED APPLICATION

This application claims the benefit of U.S. Provisional Application Ser. No. 62/633,462, filed Feb. 21, 2018, which is incorporated herein by reference in its entirety.

STATEMENT REGARDING FEDERALLY SPONSORED RESEARCH

NONE.

TECHNICAL FIELD

The present invention generally relates to foldaway shelving which can be used in, for example, vehicles. Even more specifically the present invention relates to foldaway shelving with ends caps that are raised and lowered as the shelves are raised and lowered.

BACKGROUND OF THE INVENTION

Foldaway shelving is common and its use in vehicles is common. Foldaway vehicle shelving is provided in various sizes and for various purposes. The common benefit of foldaway shelving is that it can be folded down to support items, and folded up out of the way when not being used.

The typical foldaway shelving has end caps that are fixed to the opposed ends of the shelves to hold materials on the shelves. The problem with this type of shelf is that products longer than the shelf don't fit well on the shelf. Additionally, products cannot be slid down the shelf and across an adjoining shelf. But, if there are no end caps, products on a shelf adjacent to a raised shelf can slide off the shelf.

It is desirable to provide foldaway shelving for cargo vans, cube vans, transit vehicles, etc. that don't have end caps obstructing the shelves when adjacent shelves are lowered and to have end caps when an adjoining shelf is raised. It is also desirable to provide foldaway shelving that is still relatively lightweight and cost effective. It is also desirable to provide shelving that is easy to assemble.

SUMMARY OF THE INVENTION

In general terms, this invention provides foldaway shelving which is relatively lightweight, cost effective and easy to assemble and is very effective for use in a vehicle.

The foldaway shelving unit has movable end caps on shelves mounted for pivotal movement with respect to a shelf support. Each shelf has an end with the ends adjoining each other. A first mounting bracket is attached to the first opposed end and a second mounting bracket is attached to the second opposed end. A pivot bracket connects the first and second mounting brackets. The mounting brackets and pivot brackets are pivotally mounted to the shelf support.

A first movable end cap is mounted adjacent the first end of the first shelf and a second movable end cap is mounted adjacent the second end of said second shelf. The first and second movable end caps each have a vertical wall and a horizontal wall.

The first shelf and the second shelf are independently pivotable between a lowered position and a raised position. With the first shelf and the second shelf in the lowered position, the horizontal walls of the first and second movable end caps form a bridge between the first shelf and said second shelf. When the first shelf is in the raised position, and the second shelf is in the lowered position, the pivot bracket raises the second movable end cap with respect to the second end wherein at least a portion of the vertical wall of the second movable end cap is above the support surface of the second shelf. When the second shelf is in said raised position, and the first shelf is in said lowered position, the pivot bracket raises the first movable end cap with respect to the first end of the first shelf wherein at least a portion of the vertical wall of the first movable end cap is above the support surface of said first shelf.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
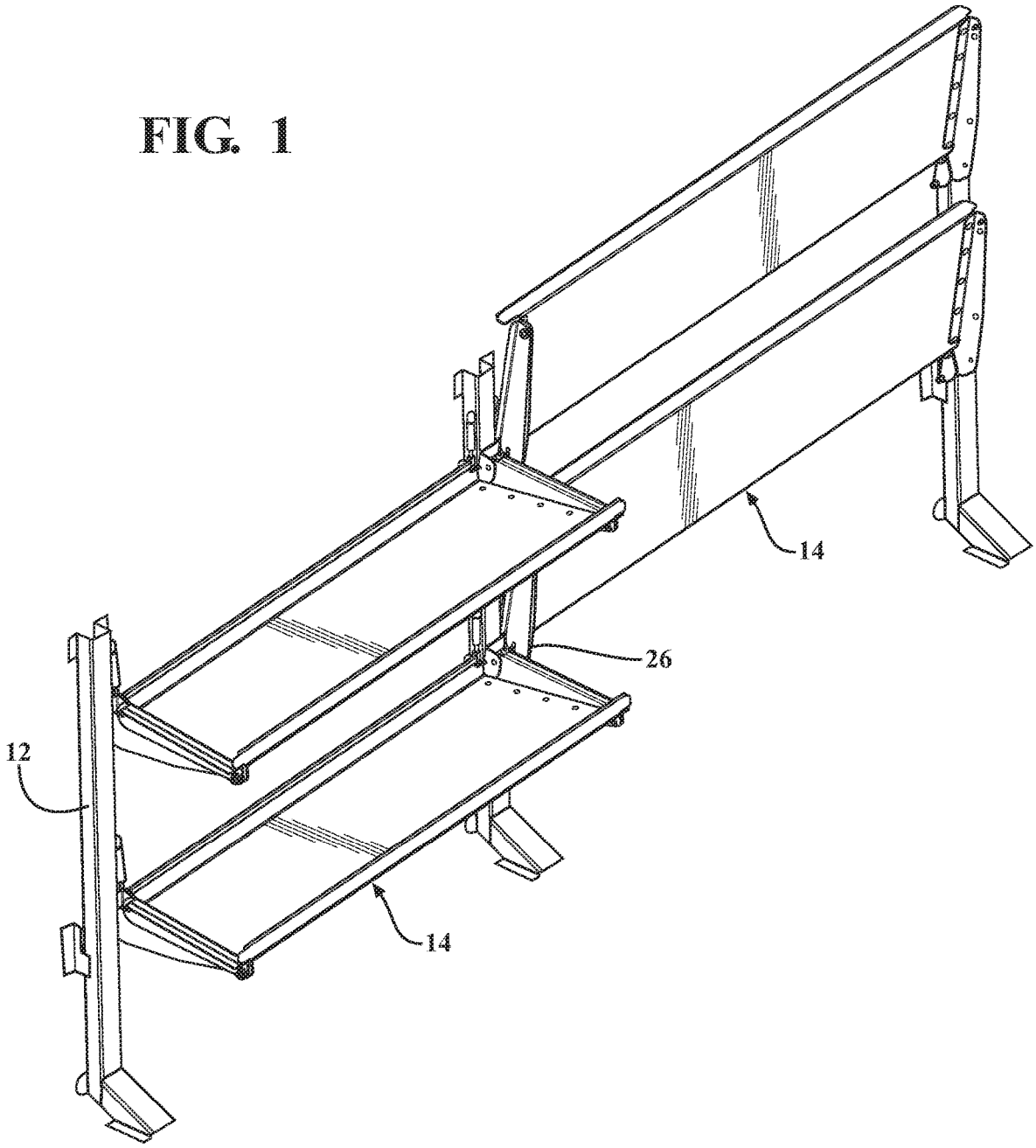
FIG. 1 is a perspective view of the foldaway shelving of the present invention.

The present invention is generally shown at 10 in FIG. 1. The foldaway shelving 10 has supports 12 for supporting the shelves 14 within for example a vehicle. In the disclosed embodiment, the supports 12 are posts, but it will be understood by one of ordinary skill in the art that the supports could be brackets, or just a wall to which the shelves are attached. Additionally, one of ordinary skill in the art will appreciate that the shelves can be used anywhere shelves are used and are not limited to use in a vehicle.

In the disclosed embodiment, the posts 12 are mounted to the floor of the vehicle and preferably with cantilevered feet 16. In the disclosed embodiment, a separate foot 16 is provided for each post 12. Side mount brackets connect the posts 12 to the interior walls of the vehicle. As will be appreciated, the use of cantilevered feet 16 transfers the weight on the shelves 14 from the vehicle walls to the vehicle floor.

In the disclosed embodiment, the cantilevered foot 16 has a top portion 17 and angled walls 19. Outwardly extending flanges 15 extend from the walls 19. Fasteners 21 are used to mount the cantilevered foot 16 to the floor of the post 12.

In the disclosed embodiment, the posts 12 are mounted to the interior side walls of the vehicle 11. The brackets are mounted to the posts 12 through either the holes 20 or slots 22. The holes and slots allow for easy mounting in a variety of vehicles.

The shelves 14 of the disclosed embodiment have a support surface 24, opposed movable end caps 26, a front wall 28 and rear wall 30 and opposed ends 32. A mounting bracket 34 is attached to the opposed ends 32. The mounting bracket is pivotally mounted to the support 12 through a pivot pen. As disclosed, the brackets 34 are generally L-shaped having an elongated body portion 36 and a raised foot portion 38. A generally perpendicular flange 40 extends along the body portion 36. The flange 40 has a series of holes 42 which mate with holes 44 in the ends 32. The mating holes 42 and 44 are adapted to receive fasteners. It should be appreciated that the flange 40 could be welded to the ends 32 or could be formed integrally with the ends 32.

Figure 7:
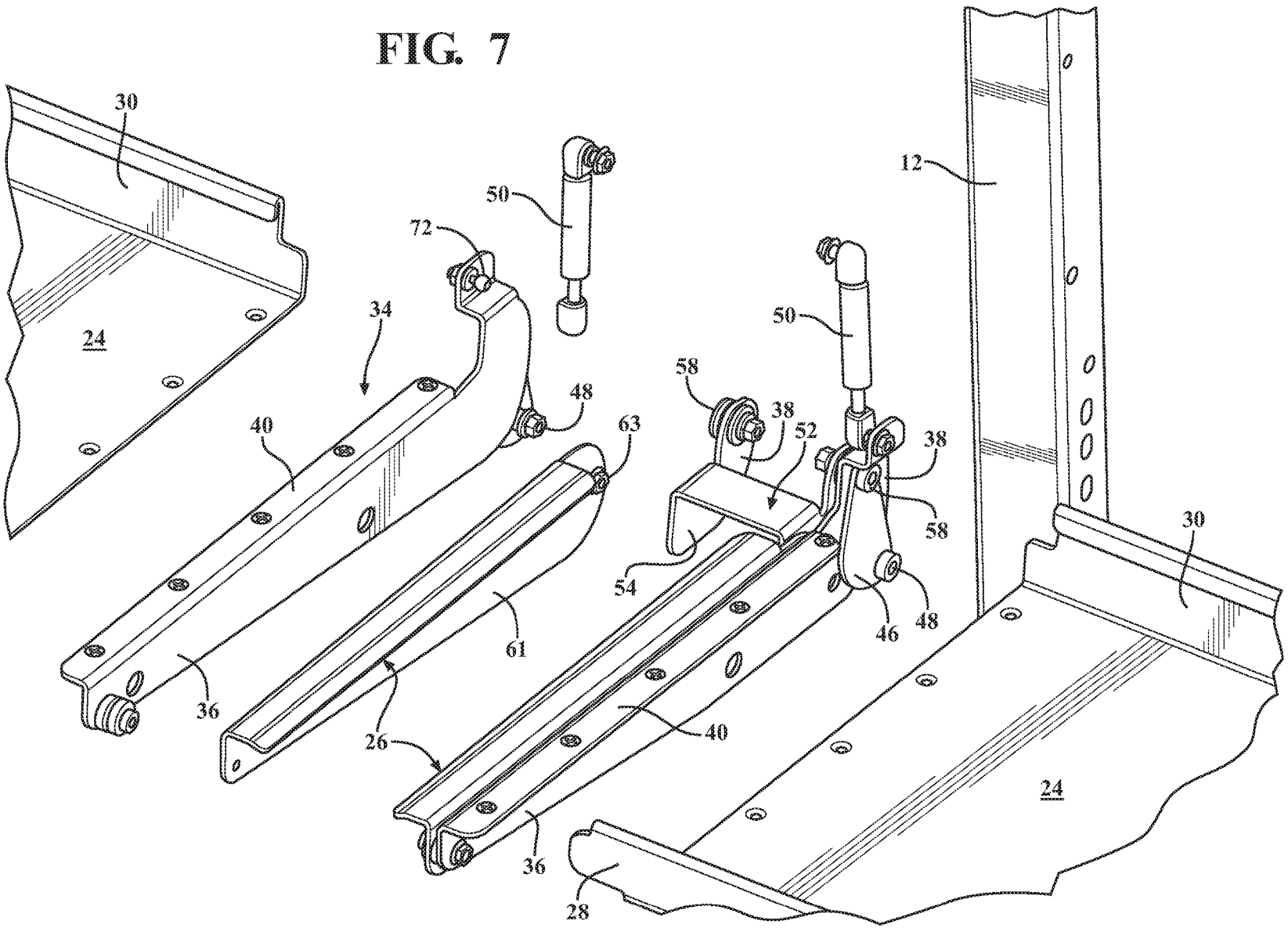
FIG. 7 is an exploded view of the foldaway shelving of the present invention of the present invention.
Figure 8:
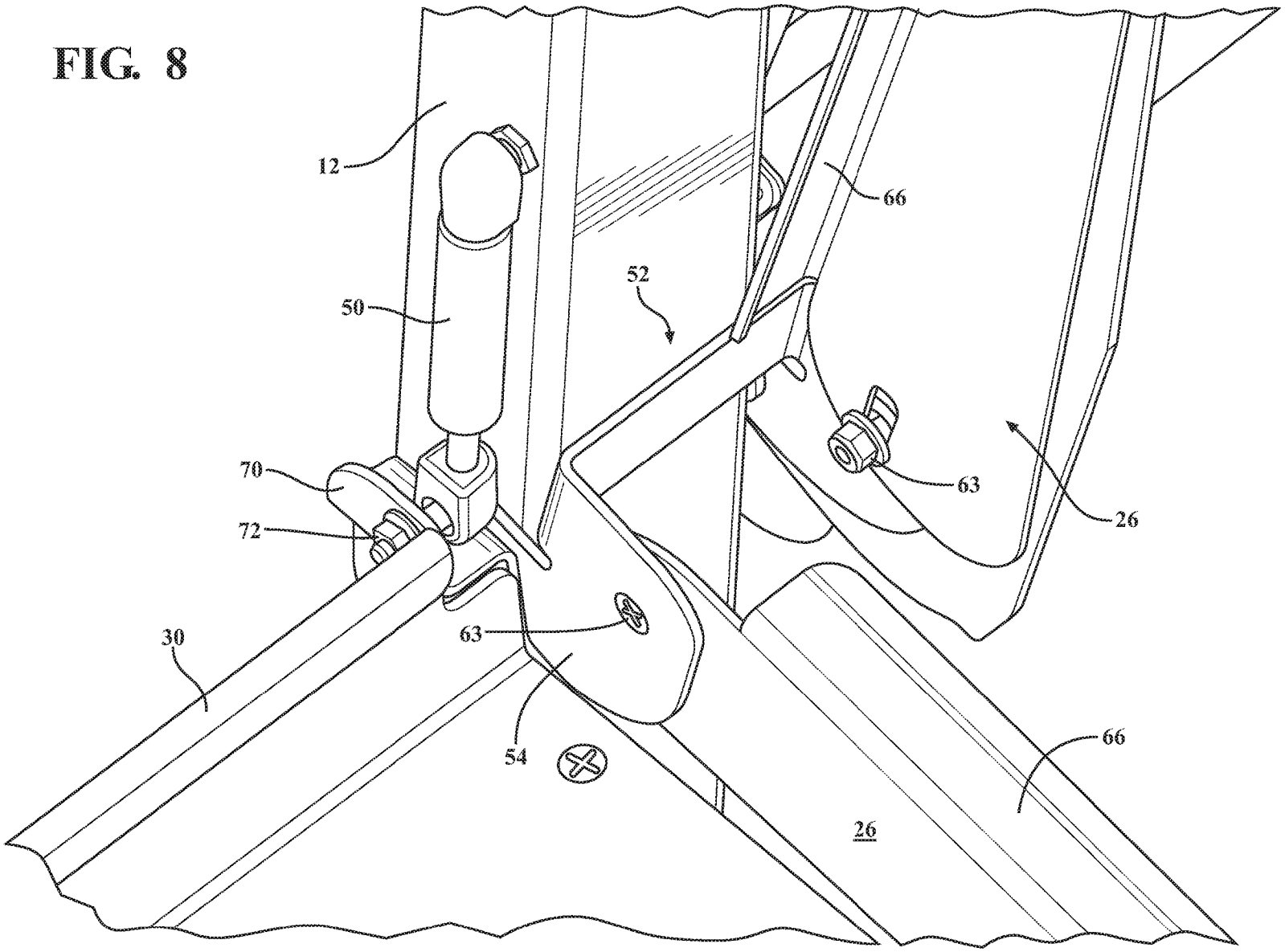
FIG. 8 is a partial perspective view of the foldaway shelving of the present invention with the shelf in the raised position.
Figure 9:
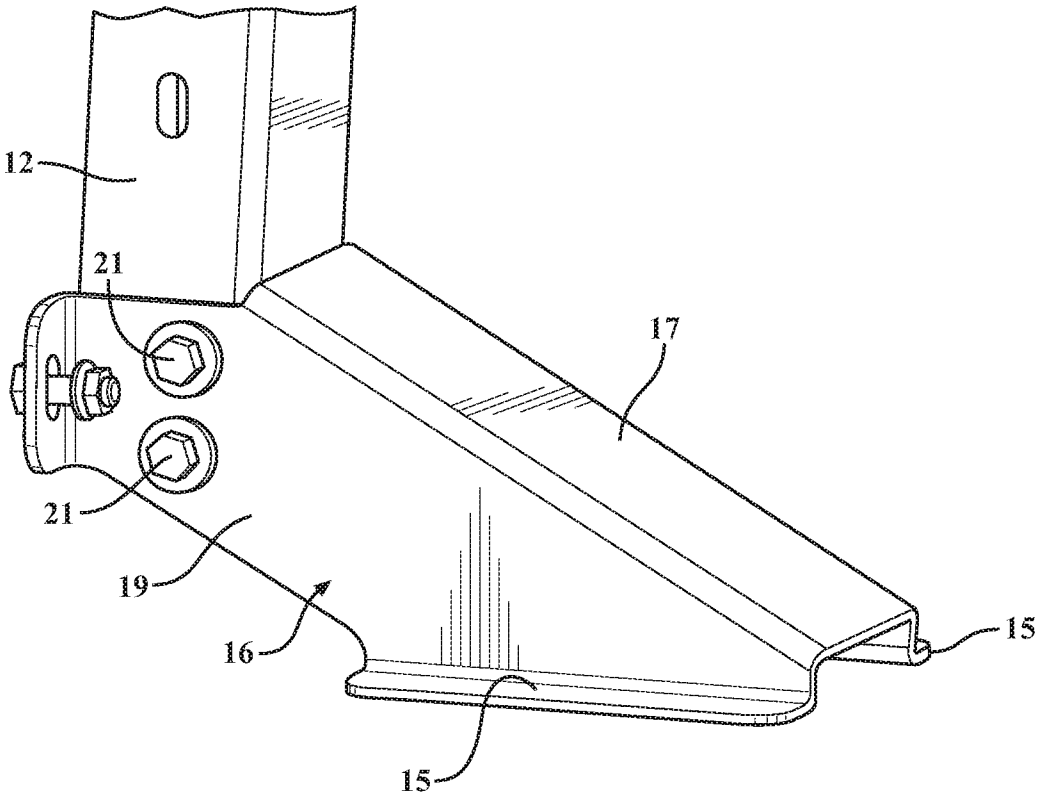
FIG. 9 is a partial perspective view of the cantilevered foot of the present invention.

In the disclosed embodiment, the brackets 34 have a knotch 49 for engaging pen 48 in the lowered position, see FIG. 7.

A pivot bracket 52 has ears 54 mounted to the foot portion 38 the plate 46 at opening 56 and to the support 12 by a pivot pin 58. The proximal end 59 of the movable end cap 26 is mounted to the proximal end of bracket 52 by a fastener 63. The distal end 61 is mounted to the distal end 62 of bracket 36 by a fastener 64. In the disclosed embodiment, the end cap 26 has a generally vertical wall 65 and a horizontal surface 66. As further disclosed, the surface 66 includes a downwardly extending lip 68.

In the disclosed embodiment, a gas shock 50 is provided to assist in the raising and lowering of the shelf 14. The bracket 34 includes a raised portion 70 for mounting one end of the shock 50 to the bracket 34. Fasteners 72 mount the gas shock 50 to the raised portion 70. The opposite end of the gas shock 50 is mounted to post 12. It will be understood that only one gas shock 50 could be used on a shelf if desired, or even no gas cylinders.

Figure 2:
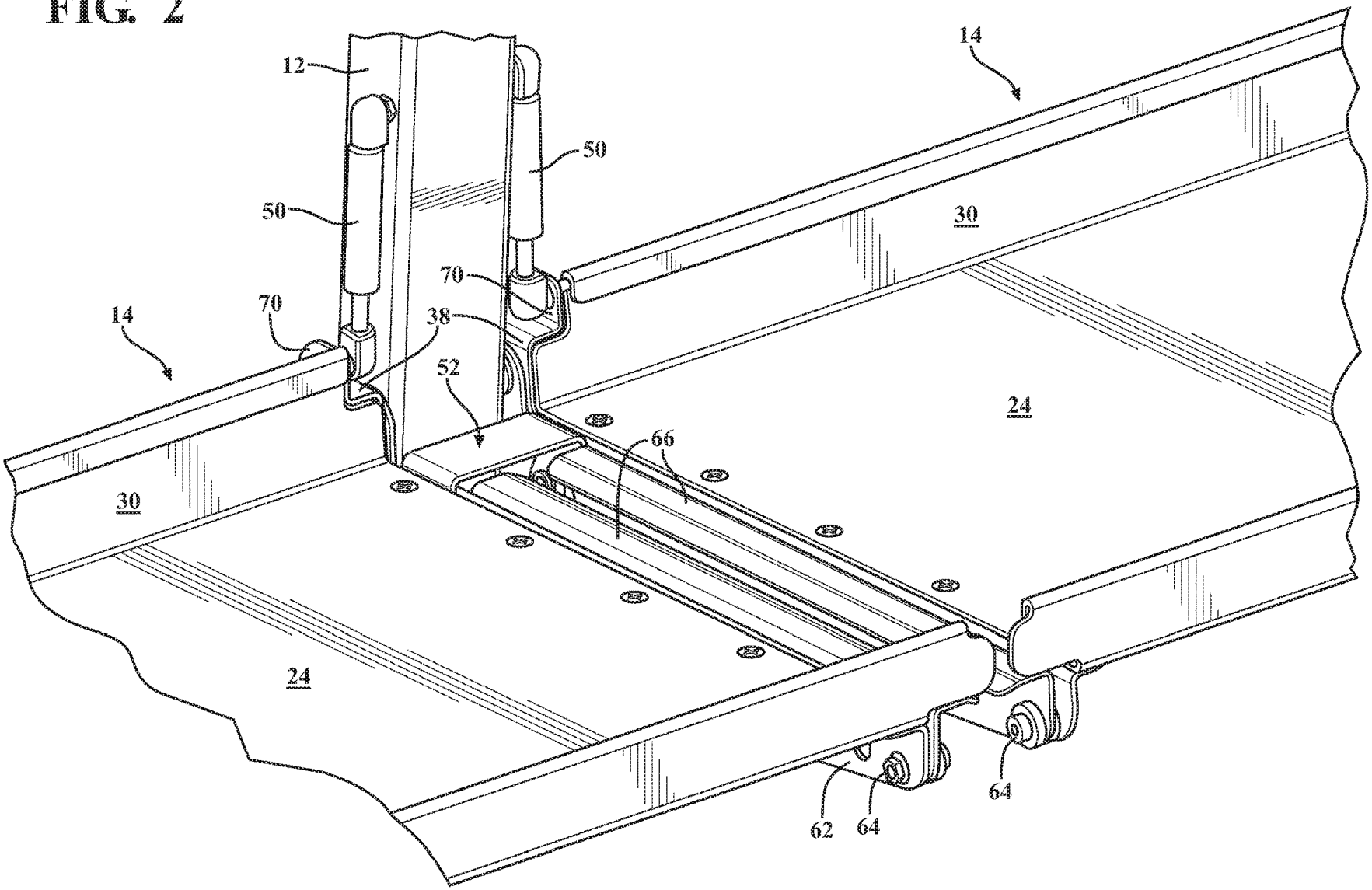
FIG. 2 is a partial perspective view of the foldaway shelving of the present invention in the lowered position.
Figure 3:
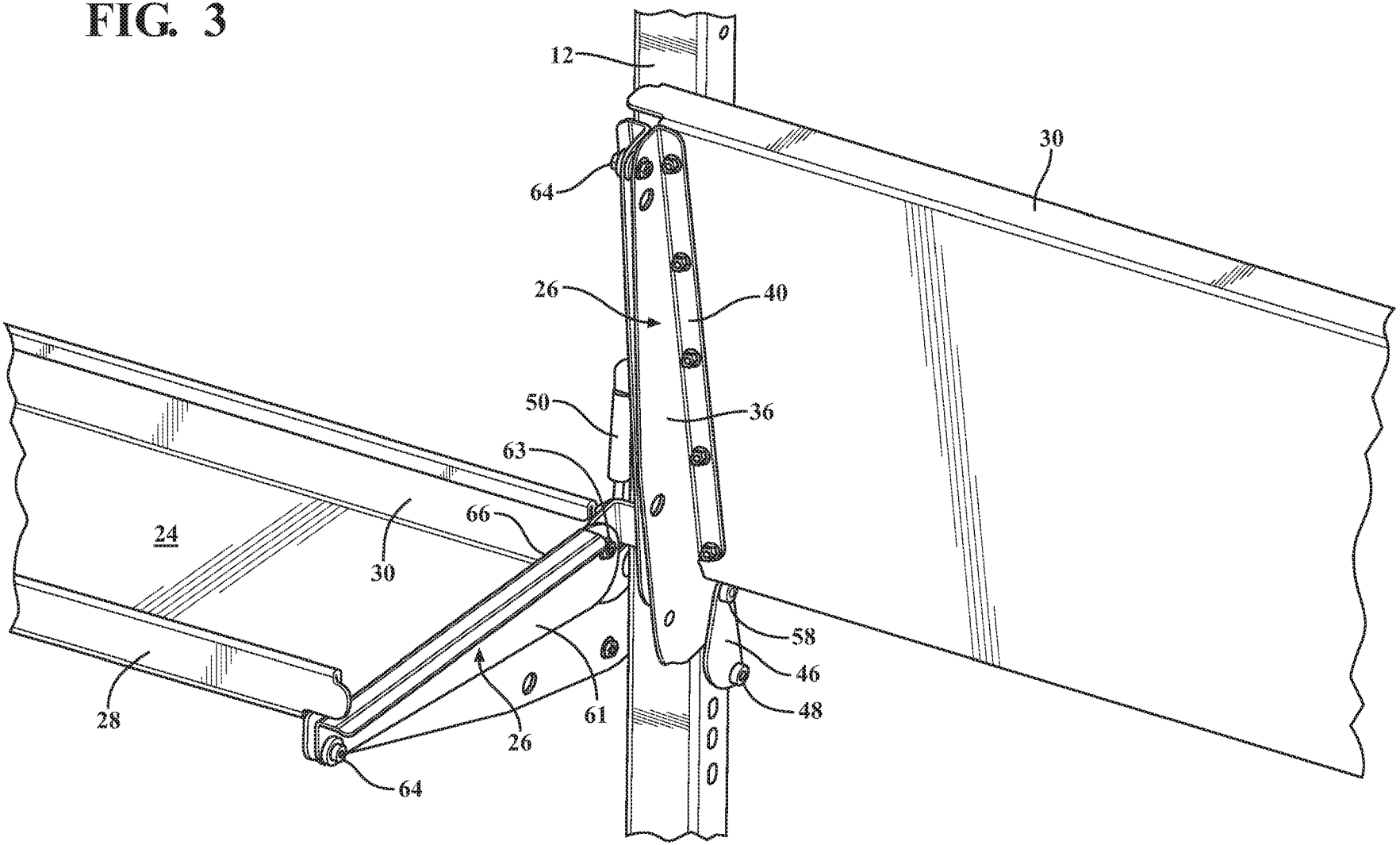
FIG. 3 is a partial perspective view of the foldaway shelving of the present invention with one shelf raised.
Figure 4:
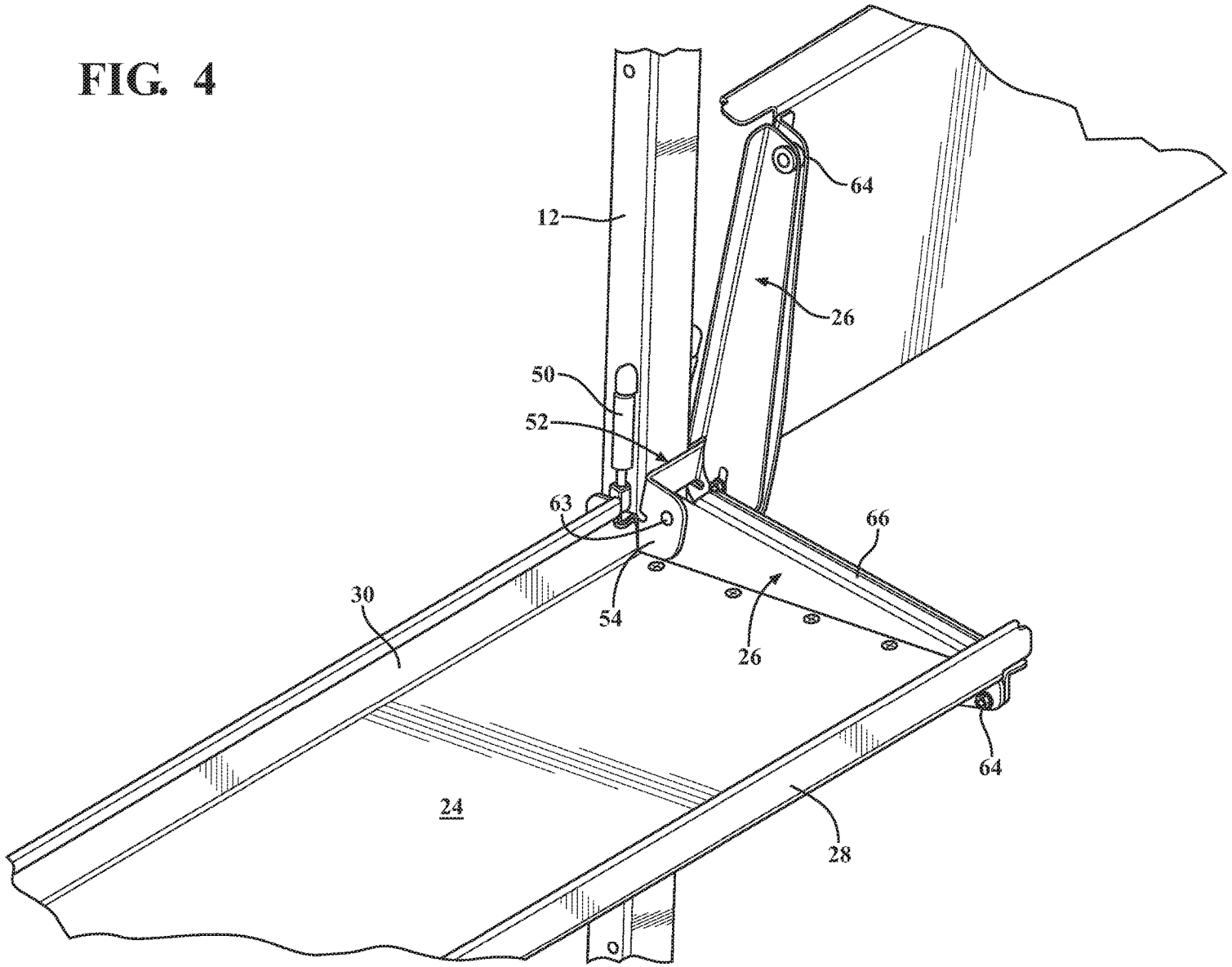
FIG. 4 is a partial perspective view of the foldaway shelving of the present invention with one shelf raised.
Figure 5:
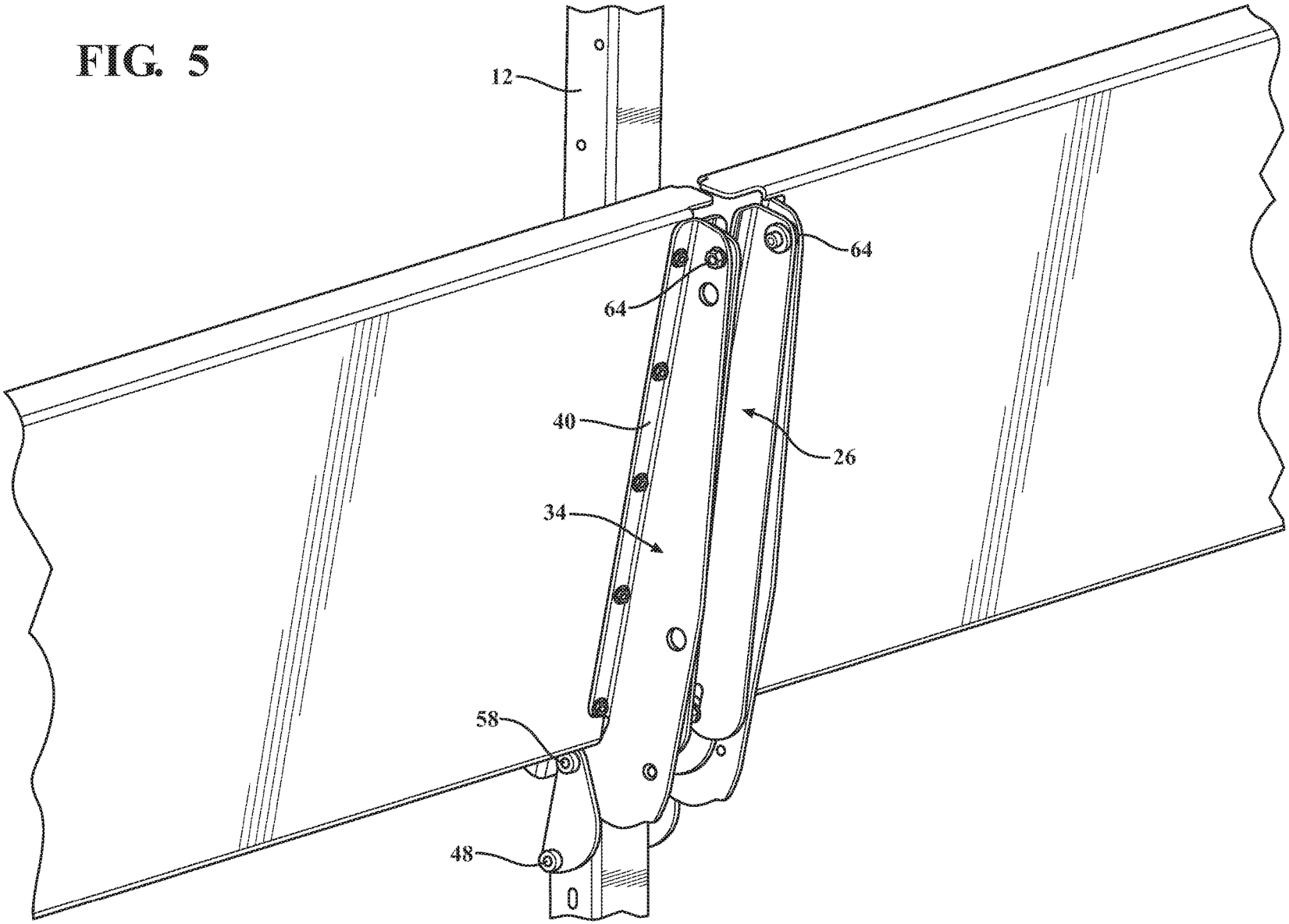
FIG. 5 is a partial perspective view of the foldaway shelving of the present invention with both shelves raised.
Figure 6:
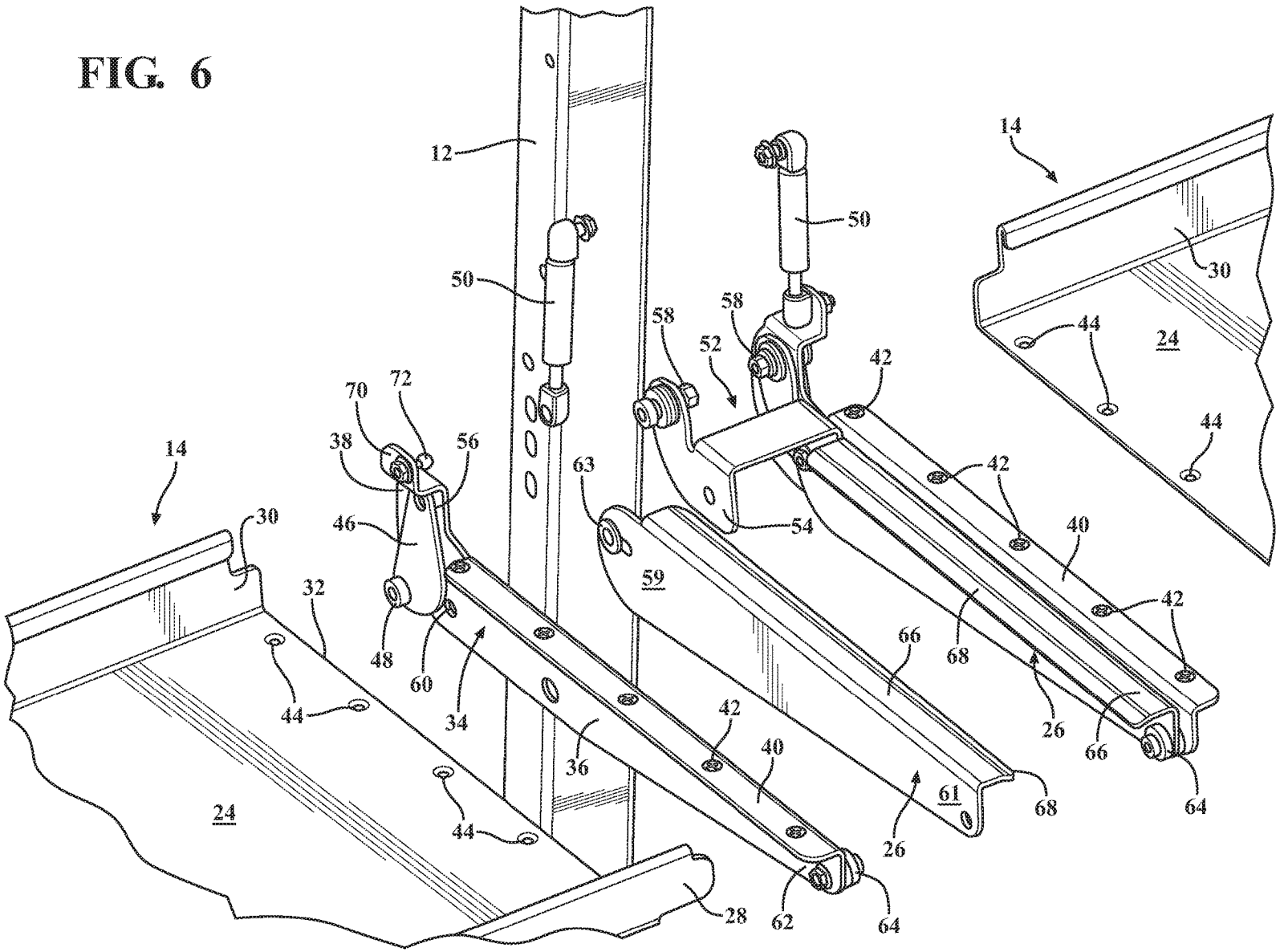
FIG. 6 is an exploded view of the foldaway shelving of the present invention.

In FIG. 2, the shelves 14 are in the downward position. In this position, the end caps 26 are in their downward most position. As illustrated, the two lowered end caps 26 form a bridge between the shelves 14 to allow product supported on the shelves to freely move along the shelves. In FIGS. 3 and 4 one of the shelves 14 is raised and the end cap of the adjoining shelf is raised to create a stop at the edge 32 of the shelf 14. The bracket 52 is rotated by the raised shelf 14 which raises the proximal end 59 of the end cap 26 to form a side wall on the end 32 of the shelf 14. In FIG. 5, both shelves 14 are raised with the end caps 36 of both shelves 14 being rotated upwardly with the shelves 14.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A foldaway shelving unit with movable end caps comprising:

a shelf support (12);

at least a first shelf (14) and a second shelf (14) mounted for pivotal movement with respect to said shelf support (12), said first shelf (14) and said second shelf (14) each having a support surface (24); said first shelf (14) having a first end (32) and said second shelf (14) having a second end (32), said first and second ends (32) being adjacent one another;

a first movable end cap (26) mounted adjacent said first end (32) of said first shelf (12) and a second movable end cap (26) mounted adjacent said second end (32) of said second shelf (12), said first and second movable end caps each having a vertical wall (65) and a horizontal wall (66);

a pivot bracket (52) interconnecting said first movable end cap (26) and said second movable end cap (26), said pivot bracket (52) is pivotally mounted to said shelf support (12);

said first shelf (12) and said second shelf (12) being independently pivotable between a lowered position and a raised position, with said first shelf (12) and said second shelf (12) in said lowered position, said horizontal walls (66) of said first and second movable end caps (26) form a bridge between said first shelf (12) and said second shelf; when said first shelf (12) is in said raised position, and said second shelf (12) is in said lowered position, said pivot bracket (52) raises said second movable end cap (26) with respect to said second end (32) wherein at least a portion of said vertical wall (65) of said second movable end cap (26) is above said support surface (24) of said second shelf (12), when said second shelf (12) is in said raised position, and said first shelf (12) is in said lowered position, said pivot bracket (52) raises said first movable end cap (26) with respect to said first end (32) of said first shelf (12) wherein at least a portion of said vertical wall (65) of said first movable end cap (26) is above said support surface (24) of said first shelf (12).

2. The foldaway shelving unit with movable end caps of claim 1, wherein said first shelf (12) and second shelf (12) each have longitudinally extending front and rear walls.

3. The foldaway shelving unit with movable end caps of claim 1, further including a first mounting bracket (34) attached to the said first opposed end (32) and a second mounting bracket (34) attached to the said second opposed end (32).

4. The foldaway shelving unit with movable end caps of claim 3, wherein said first and second mounting brackets (34) are connected to said pivot bracket (52).

5. The foldaway shelving unit with movable end caps of claim 3, wherein said first and second brackets (34) are generally L-shaped having an elongated body portion (36) and a raised foot portion (38).

6. The foldaway shelving unit with movable end caps of claim 4, wherein said each of said first and second mounting brackets (34) include a generally horizontal flange (40) extending along the body portion (36), said flange (40) is connected to each of said respective first shelf and second shelf (12).

7. The foldaway shelving unit with movable end caps of claim 5, further including a plate (46) having an upper portion and a lower portion, and a pivot pin (58), said upper portion is mounted to said foot portion (38) of said mounting bracket (34) and to said support (12) through said pivot pin (58) and said lower portion is mounted to said support (12).

8. The foldaway shelving unit with movable end caps of claim 7, wherein said pivot pin (48) stops the pivotal movement of said shelf (14) in the downward most position.

9. The foldaway shelving unit with movable end caps of claim 1, wherein said first and second movable end caps (26) are elongated having a proximal end (59) and a distal end (61);

said pivot bracket (52) is generally u-shaped having first and second ears (54), said first ear (54) is connected to said proximal end (59) of said first movable end cap and said second ear (54) are connected to said proximal end (59) of second movable end cap (26).

10. The foldaway shelving unit with movable end caps of claim 9, further including a first mounting bracket (34) attached to the said first opposed end (32) and a second mounting bracket (34) attached to the said second opposed end (32);

said distal end (61) of said first movable end cap (26) is pivotally connected to said first mounting bracket (34) and said distal end (61) of said second movable end cap (26) is pivotally connected to said second mounting bracket (34).

11. The foldaway shelving unit with movable end caps of claim 1, further including at least one lift assist (50) to assist in the raising and lowering of at least one of said shelves (14).

12. The foldaway shelving unit with movable end caps of claim 11, further including a first mounting bracket (34) attached to the said first opposed end (32) and a second mounting bracket (34) attached to the said second opposed end (32), said first and second brackets (34) each includes a raised portion (70);

said lift assist (50) has a top and a bottom, said bottom is mounted to said raised portion (70) and said top is mounted to said support (12).

13. The foldaway shelving unit with movable end caps of claim 1, wherein said shelf support includes two spaced posts (12), said posts being mounted to the cantilevered feet.

14. The foldaway shelving unit with movable end caps of claim 1, wherein said shelf support includes two spaced posts (12), said posts are mounted to cantilevered feet.

15. A foldaway shelving unit with movable end caps comprising:

a shelf support (12);

at least a first shelf (14) and a second shelf (14) mounted for pivotal movement with respect to said shelf support (12), said first shelf (14) and said second shelf (14) each having a support surface (24); said first shelf (14) having a first end (32) and said second shelf (14) having a second end (32), said first and second ends (32) being adjacent one another;

a first mounting bracket (34) attached to the said first opposed end (32) and a second mounting bracket (34) attached to the said second opposed end (32), said first and second mounting brackets (34) are pivotally connected to said pivot bracket (52);

a first movable end cap (26) mounted adjacent said first end (32) of said first shelf (12) and a second movable end cap (26) mounted adjacent said second end (32) of said second shelf (12), said first and second movable end caps each having a vertical wall (65);

a pivot bracket (52) interconnecting said first movable end cap (26) and said second movable end cap (26), said pivot bracket (52) is pivotally mounted to said shelf support (12);

said first shelf (12) and said second shelf (12) being independently pivotable between a lowered position and a raised position, with said first shelf (12) and said second shelf (12) in said lowered position, said movable end caps (26) do not obstruct said support surface (24) of said first shelf (12) and said second shelf (12); when said first shelf (12) is in said raised position, and said second shelf (12) is in said lowered position, said pivot bracket (52) raises said second movable end cap (26) with respect to said second end (32) wherein at least a portion of said vertical wall (65) said second movable end cap (26) is above said support surface (24) of said second shelf (12), when said second shelf (12) is in said raised position, and said first shelf (12) is in said lowered position, said pivot bracket (52) raises said first movable end cap (26) with respect to said first end (32) of said first shelf (12) wherein at least a portion of said vertical wall (65) of said first movable end cap (26) is above said support surface (24) of said first shelf (12).

16. The foldaway shelving unit with movable end caps of claim 15, wherein said first shelf (12) and second shelf (12) each have longitudinally extending front and rear walls.

17. The foldaway shelving unit with movable end caps of claim 15, wherein said first and second brackets (34) are generally L-shaped having an elongated body portion (36) and a raised foot portion (38).

18. The foldaway shelving unit with movable end caps of claim 15, wherein said each of said first and second mounting brackets (34) include a generally horizontal flange (40) extending along the body portion (36), said flange (40) is connected to each of said respective first shelf and second shelf (12).

19. The foldaway shelving unit with movable end caps of claim 17, further including a plate (46) having an upper portion and a lower portion, and a pivot pin (58), said upper portion is mounted to said foot portion (38) of said mounting bracket (34) and to said support (12) through said pivot pin (58) and said lower portion is mounted to said support (12).

20. The foldaway shelving unit with movable end caps of claim 19, wherein said pivot pin (48) stops the pivotal movement of said shelf (14) in the downward most position.

21. The foldaway shelving unit with movable end caps of claim 15, wherein said first and second movable end caps (26) are elongated having a proximal end (59) and a distal end (61);

said pivot bracket (52) is generally u-shaped having first and second ears (54), said first ear (54) is connected to said proximal end (59) of said first movable end cap and said second ear (54) is connected to said proximal end (59) of second movable end cap.

22. The foldaway shelving unit with movable end caps of claim 21, wherein said distal end (61) of said first movable end cap (26) is pivotally connected to said first mounting bracket (34) and said distal end (61) of said second movable end cap (26) is pivotally connected to said second mounting bracket (34).

23. The foldaway shelving unit with movable end caps of claim 15, further including at least one lift assist (50) to assist in the raising and lowering of at least one of said shelves (14).

24. The foldaway shelving unit with movable end caps of claim 23, wherein said first and second brackets (34) each includes a raised portion (70);

said lift assist (50) has a top and a bottom, said bottom is mounted to said raised portion (70) and said top is mounted to said support (12).

* * * * *